US005950343A

United States Patent [19]

Dingle

[11] Patent Number: 5,950,343

[45] **Date of Patent: *Sep. 14, 1999**

[54] METHOD FOR ASSEMBLING POSTER FRAME WITH NON-SLIDING SPRING MECHANISM

[76] Inventor: Ralph W. Dingle, 21675 Green Hill, Apt 114, Farmington Hills, Mich. 48335

[ * ] Notice: This patent is subject to a terminal disclaimer.

[21] Appl. No.: 09/111,501

[22] Filed: Jul. 7, 1998

Related U.S. Application Data

[63] Continuation-in-part of application No. 08/819,328, Mar. 18, 1997.

[51] Int. Cl.[6] ..... G09F 1/12

[52] U.S. Cl. ..... 40/793; 40/647

[58] Field of Search ..... 40/793, 792, 647

[56] References Cited

U.S. PATENT DOCUMENTS

| | | | |
|---|---|---|---|
| 2,581,843 | 1/1952 | Edwards | 40/793 |
| 3,310,901 | 3/1967 | Sarkisian . | |
| 4,145,828 | 3/1979 | Hillstrom . | |
| 4,505,010 | 3/1985 | Arenhold . | |
| 4,512,094 | 4/1985 | Seely . | |
| 4,523,400 | 6/1985 | Seely . | |
| 4,958,458 | 9/1990 | Hillstrom . | |
| 4,986,491 | 1/1991 | Gelardi . | |
| 5,307,575 | 5/1994 | Ivansson et al. | 40/793 |

*Primary Examiner*—Cassandra H. Davis

[57] ABSTRACT

A method of assembling a poster frame made from a plurality of frame sections, each frame section having a base member and cover member rotatably fastened together. One or more flat metal spring biasing members having a first opposed pair of smooth edges and a second opposed pair of sawtooth or irregular edges are positioned between the rotating cover and base members. The spring members are first positioned with the smooth edges in contact with the rotating members until they are aligned, and then with the sharp edges in contact with the members. The projections on the irregular edges of the spring members are preferably pointed and embed in the metal channels of the cover and base members and dig grooves therein, preventing the cover and base member from sliding longitudinally relative to one another. Various configurations of toothed and pointed members can be utilized on the opposed irregular edges of the spring biasing member. Preferably, the irregular edges have one or more flat areas in order to prevent the spring members from embedding too deeply in the channels in the cover and base members.

4 Claims, 2 Drawing Sheets

METHOD FOR ASSEMBLING POSTER FRAME WITH NON-SLIDING SPRING MECHANISM

CROSS REFERENCE TO RELATED APPLICATIONS

This application is a continuation of application Ser. No. 08/819,328, filed Mar. 18, 1997.

TECHNICAL FIELD

The present invention relates to spring-biased picture and poster frames, and more particularly to an improved non-sliding spring mechanism therefor.

BACKGROUND OF THE INVENTION

U.S. Pat. Nos. 3,310,901 and 4,145,828 disclose spring-biased front loading picture and poster frames. The frames have a plurality of frame sections, each frame section having a base member attached to a backing member and a rotatable cover member attached to each of the base members. Spring biasing mechanisms, such as S-shaped springs or bowed flat springs are used to bias the cover member relative to the base member in its open and closed positions. One or more metal spring members are used to bias the cover members on each of the sides of the poster frame. The poster frames in accordance with the '901 and '828 patents work very well and have secured substantial success in the marketplace.

Known picture and poster frames made in accordance with the '901 and '828 patents are typically made from a plurality of frame sections mitered at 45° in the corners. The members forming each of the frame sections are typically made from an extruded metal material, such as aluminum. Also, it is possible to provide frames made from frame sections of extruded plastic materials. With the plastic extrusions, the spring mechanism is extruded integrally with the base and cover members. Frames of this type are shown, for example, in U.S. Pat. Nos. 4,512,094 and 4,523,400.

When extruded metal materials, such as aluminum, are used for the base members and cover members in poster frames, experiences have shown that over time and frequent usage of the poster frame, the cover members can slide longitudinally or laterally relative to the base member. Such sliding can cause difficulties during opening and closing of the frame sections. In order to prevent such sliding movement, one or more threaded rod members or mechanisms can be utilized, such as shown, for example, in U.S. Pat. No. 4,958,458. The two frame members can also be notched or staked together to prevent relative lateral movement.

It is an object of the present invention to provide an improved picture and poster frame. It is another object of the present invention to provide a picture and poster frame with a spring mechanism which eliminates rail locks and other mechanisms typically utilized with metal extruded frame sections to hold them from sliding laterally relative to one another.

It is a further object of the present invention to provide a poster frame which is simpler and less expensive to manufacture and assemble than known picture and poster frames. It is a still further object of the present invention to provide a spring mechanism for a poster frame which creates a final product which is easier to manufacture and assemble and which is less expensive.

SUMMARY OF THE INVENTION

The present invention provides a spring mechanism for a front loading picture and poster frame which effectively prevents rotating cover members from sliding longitudinally relative to fixed base members. The poster frames are comprised of a plurality of frame sections forming a rectangular perimeter around a backing member. Each of the frame sections has a base member attached to the backing member and a rotatable cover member hingedly attached to each of the base members.

The frame sections are mitered 45° at their ends in order to provide a finished poster frame. The base member and cover member for each of the frame sections are made from an extruded metal material, such as aluminum.

One or more spring members are positioned in each of the frame sections between a channel in the base member and a corresponding channel in the cover member. The spring members bias the cover member relative to the base member and retain the cover member in its open and closed positions relative to the base and backing members.

The spring members preferably comprise square or rectangular pieces of metal material, such as spring steel or stainless steel, and have sawtooth, serrated, or irregular edges on two of their opposed edges. The serrated edges can have a sawtooth shape or various toothed designs which prevent the teeth from penetrating too deeply into the channels in the base and cover members. The irregular edges or sawteeth securely hold the spring member in place in both the base and cover portions of the frame sections. The spring members prevent the cover members from sliding longitudinally relative to the base members.

Preferably, the two other opposed edges of each of the spring members are smooth or straight. For alignment purposes during assembly of the poster frames, the spring members can be positioned between the channels in the base member and cover member utilizing the straight edges. Thereafter, once the frame sections are aligned, at least one of the spring members for each of the frame sections is rotated 90° in order to lock the base and cover members securely in position.

These and other purposes, features and benefits of the present invention will become apparent from the following description of the invention, when viewed in accordance with the attached drawings and appended claims.

DESCRIPTION OF THE PREFERRED EMBODIMENTS

Figure 1:
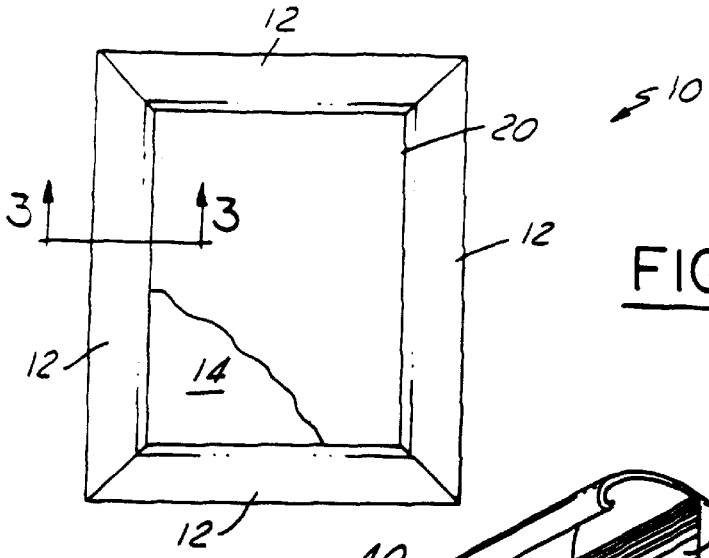
FIG. 1 is a front view of a picture and poster frame in accordance with the present invention.

As illustrated in FIG. 1, the improved picture and poster frame, generally designated by the reference numeral 10, comprises a plurality of frame sections 12. As with most conventional picture and poster frames, the frame 10 is rectangular in shape and has four frame sections 12 forming its periphery. The frame sections 12 surround a backing member 14 which is used to support a picture, poster, or other display material 20 positioned in the frame.

Figure 2:
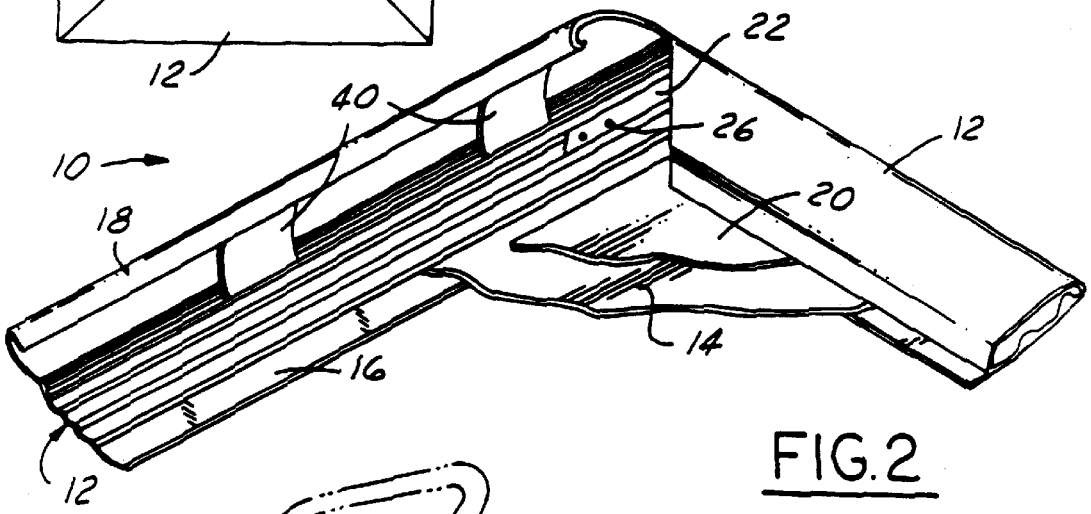
FIG. 2 is a partial perspective view of the poster frame shown in FIG. 1 with one of the frame sections in its open position.
Figure 3:
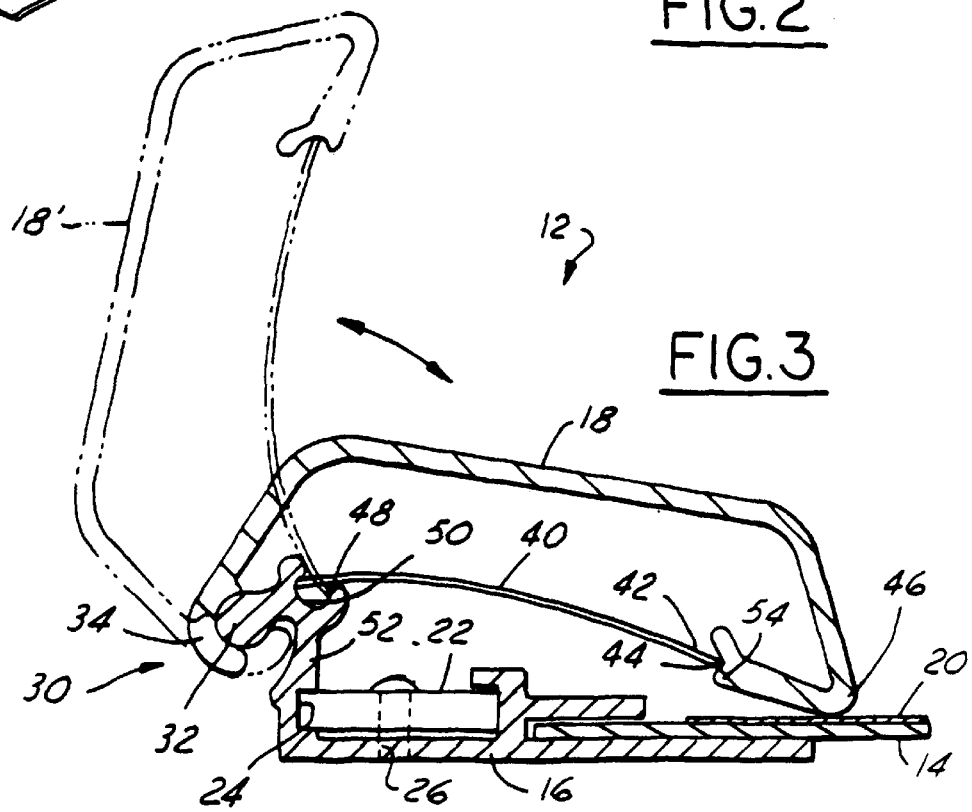
FIG. 3 is a cross-sectional view of one of the frame sections shown in FIG. 1, the cross-section being taken along line 3—3 in FIG. 1 and in the direction of the arrows.

As shown in FIGS. 2 and 3, each of the frame sections 12 are comprised of two extruded metal frame members 16 and 18 which are pivoted together. Frame member 16 is a base member and frame member 18 is a front or cover member.

The frame members 16 and 18 of each frame section 12 are cut to the desired length and mitered 45° at their opposite ends for abutting and coplanar assembly with one another to outline the frame 10. As will be understood, the frame 10 can be square or rectangular, although it is also possible for the frame to have any desired polygonal shape with an appropriate number of sections 12 mitered at appropriate angles. Also, it is possible for each of the front or cover extrusions 18 to be comprised of a number of extruded pieces of shorter length.

The backing member 14 preferably is made from a rigid material, such as aluminum, Masonite™, or another suitable material. The frame sections 12 are positioned around the edges of the backing member 14 to form the completed frame and display holder. A poster 20 or other display material is positioned on the backing member 14 and held in place around its edges by the frame sections 12.

The frame 10 can be fastened in any conventional means to a rigid or supporting member such as a post, wall or the like. It is also possible for the backing member 14 to be attached to a mounting surface. It is further understood that the use of a backing member 14 is not always necessary. For example, the frame 10 can be mounted on a flat surface forming its own backing member, or the display materials 20 can be made of rigid or stiff materials without the need for a backing member.

In accordance with the present invention, the frame members 16 and 18 are made of a metal material, such as aluminum. The aluminum material preferably is extruded and provides an attractive external appearance and a pleasing and durable frame and display structure.

Adjacent frame sections 12 of the frame 10 are held and fastened together by L-shaped corner braces or members 22 (as shown in FIGS. 2 and 3). The corner members 22 are positioned in suitable recesses 24 in each of the base members 16 and held in place by fasteners 26, such as screws or pop rivets. The cover or front member 18 of each frame section 12 is assembled to the base member 16 by means of a hinge assembly or mechanism 30. The hinge mechanism is comprised of a cylindrical hinge or pivot pintle formation 32 extending outwardly from the base member 16 and a corresponding cup-shaped formation 34 formed on the cover member 18. Preferably, the edges of the cup member 34 extend more than 180° around the pivot member 32 and the two members 16 and 18 thus are either slidably assembled in the longitudinal direction or snapped together.

As shown by the dashed outline in FIG. 3, the hinge mechanism 30 allows the cover member 18 to pivot relative to the base member 16. When the cover member 18 is in the position shown in solid lines in FIG. 3, it holds the display materials 20 tightly in position in the frame 10 against the backing member 14. When it is desired to remove or replace the display materials 20, the cover member 18 is rotated or pivoted to the dashed outlined position 18' permitting removal of the poster or display materials.

One or more leaf springs 40 are positioned in each of the frame sections 12 extending between the base member 16 and cover member 18. The spring members 40 bias the two members relative to one another. The spring members 40 act to maintain a snug mating pivotal engagement between members 16 and 18, bias the cover members 18 against the display materials 20 and the backing member 14 when the frame members are "closed", and hold the cover members 18 in their "open upright" position (18' in FIG. 3) for removal or replacement of the display materials. Spring members 40 are preferably made of a good grade of spring steel or stainless steel and preferably have a flat square or rectangular shape. The spring members are adapted to be flexed or bowed when the cover member 18 is rotated and provides the desired cantilever snap-action for the frame sections 12.

One end 42 of each of the spring members 40 is positioned in an elongated groove or channel 44 at the end 46 of the cover member 18. The opposite end 48 of the spring member 40 rests in groove or channel 50 in the flange 52 of the base member 16. The groove or channel 50 extends longitudinally the full length of the base member 16 and preferably has an arcuate-shaped cross-section. Although the cross-section of channel 50 can have any conventional size and shape, it preferably is formed in accordance with the disclosure of U.S. Pat. No. 4,145,828, the disclosure of which is hereby incorporated herein by reference. In accordance with the '828 patent, channel 50 has an arcuate section that extends approximately 90° and is bounded on two sides by flat wall surfaces, the planes of which are substantially perpendicular to each other.

The shape and position of the channel 50 preferably allows unrestricted movement of the end 48 of the spring member 40 over a 90° arc as the cover member 18 is opened and closed. The channel 50 also is formed in order to prevent the end 48 of spring member 40 from being displaced from it. The channel 50 further allows use of a flat or bowed leaf spring member 40 which can be easily manufactured without expensive and time-consuming roll-forming and bending, which does not have to be manufactured and fabricated within stringent tolerance limits, and which can be quickly and easily installed in the frame sections 12.

In the assembly of frame sections 12, the frame members 16 and 18 are first longitudinally slid or snapped together at the hinge assembly 30. Next, the extruded members 16 and 18 are brought into end-to-end lateral register with one another. Once aligned, cover member 18 is rotated to its open position (18' in FIG. 3) and end 48 of spring member 40 is positioned in channel 50. Force is then applied to the spring member 40 until the other end 42 is slid past hook formation 54 on end 46 of cover member 18 and snapped into its final position in the groove or channel 44.

The spring member 40 exerts an inward and outward over-center force to fixedly retain the movable frame section members in either their closed or open positions. In either position, the spring member 40 urges the cover member 18 in a direction to maintain its integral concave hinge formation 34 snugly against the integral convex formation 32 of the base member 16.

Figure 4:
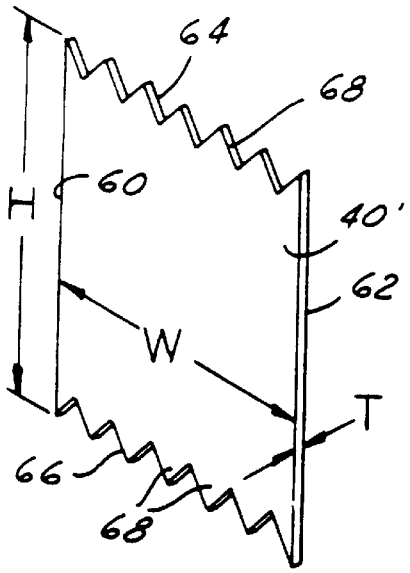
FIG. 4 illustrates a representative spring biasing member in accordance with the present invention.

A spring member 40' for use with the frame sections 12 in accordance with the present invention is shown in FIG. 4. The spring member is made from a flat piece of metal material, such as spring steel or stainless steel. The thickness T of the spring member 40' is on the order of 0.010 inches to 0.030 inches. The spring member 40' can have a square configuration with the width W equaling the height H, or the spring member 40' can have a rectangular shape with the height H exceeding the width W. Since the spring members can be used with frames 10 of various sizes, the width W and height H of the spring members are typically in the range from 0.50 to 2.50 inches.

The unique spring member 40' has four edges 60, 62, 64 and 66. Edges 60 and 62 are straight or planar while edges 64 and 66 are serrated or irregular in shape, such as with the sawtooth formation shown in FIG. 4. With a serrated sawtooth formation, a plurality of pointed ends or peaks 68 are formed.

When the spring member 40' as shown in FIG. 4 is installed in a frame section 12, the pointed ends 68 of the edges 64 and 66 embed in the grooves or channels 44 and 50, thereby securely holding the spring member in place. The slight bow incorporated in the spring member 40' when it is installed in place, creates sufficient force causing the pointed ends 68 to be embedded in the metal material in the two channels or grooves.

Once the spring member 40' is installed in place between the base member 16 and cover member 18, the spring member prevents the two frame members 16 and 18 from sliding longitudinally relative to one another. Upon repeated opening and closing of the cover member 18 relative to the base member 16, the pointed ends 68 form arcuate grooves in each of the channels 44 and 50 which allow the spring member to easily rotate in the channels and further aid in holding the two frame members 16 and 18 fixed in lateral position.

In accordance with the present invention, the edges 64 and 66 of the spring member 40 can have any type of irregular, serrated or pointed shapes, so long as they contain one or more points to embed in the material in the channels 44 and 50 and prevent the cover and base members from moving laterally relative to one another.

It is also preferred that edges 60 and 62 of spring member 40' be maintained planar or flat without any irregularities. In this manner, when a square spring member 40' is utilized, the edges 60 and 62 can first be installed in the frame sections between channels 44 and 50 until the cover member 18 and base member 16 are properly aligned laterally. Once the final position is ascertained, then the spring member 40' can be removed from its position and turned 90° so that irregular edges 64 and 66 are positioned in the channels 44 and 50. When the spring members 40 are installed with edges 64 and 66 in the channels, the two frame members are laterally fixed in position.

Figure 5:
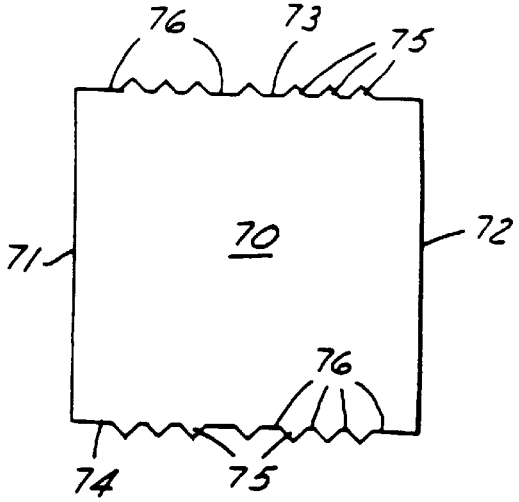
FIG. 5 illustrates an alternate embodiment of a spring member in accordance with the present invention.

Another embodiment of a spring biasing member which can be used with the present invention is shown in FIG. 5 and designated by the reference numeral 70. The spring member 70 has a pair of opposed straight edges 71 and 72, and a pair of irregularly shaped edges 73 and 74. The irregular edges have a series of pointed projections 75 thereon which act to retain the spring member in the channels 44 and 50 in the frame sections and prevent the frame sections 16 and 18 from moving laterally.

The spring member 70 also contains flat or straight areas 76 inbetween the projections 75. The "flats" 76 rest in the channels 44 and 50 and prevent the spring member from embedding too deeply therein. The flat areas 76 which comprise the majority of the length of the edges 73 and 74 rest in the bottom of channels 44 and 50, while the pointed members 75 embed in the material in the channels.

Figure 6:
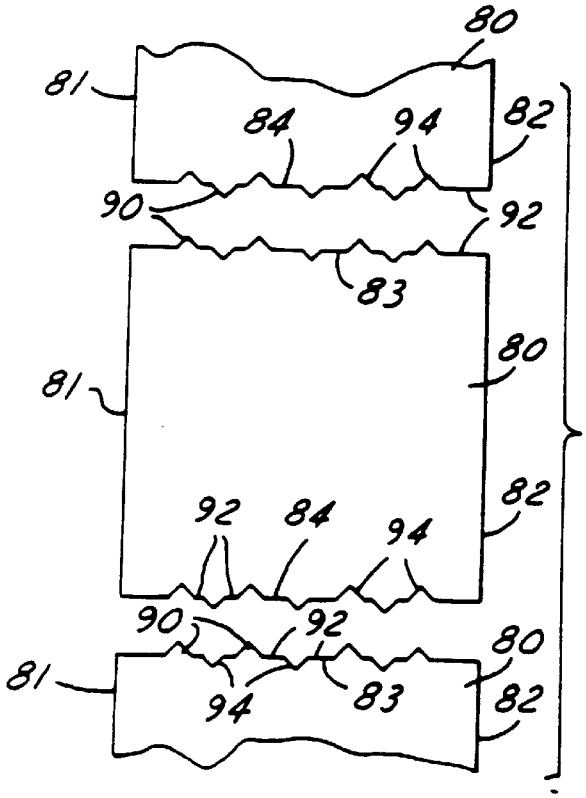
FIG. 6 illustrates a preferred method for manufacturing the spring members in accordance with the present invention.

Another embodiment of the present invention is shown in FIG. 6. The spring member 80 is made from materials similar to spring members 40' and 70 and also contains two straight edges 81 and 82 and two irregular or pointed edges 83 and 84. In this embodiment, each of the edges 83 and 84 have a series of pointed members 90, a plurality of flat areas 92, and a plurality of recessed areas 94. The particular arrangement of points and recesses, as shown in FIG. 6, allow the spring members to be manufactured continuously from a single strip of metal material without any waste. As shown in FIG. 6, edges 83 and 84 have corresponding peak members and recesses and thus mate precisely together as shown. With such spring members 80, a plurality of spring members can be formed from a strip of metal material without any waste.

Although the preferred embodiment of the present invention uses flat or bowed spring members (see U.S. Pat. No. 4,145,828), the spring members could have one or more bends or folds therein, such as shown in U.S. Pat. No. 3,310,901, or one or both ends could be folded over with the serrations or teeth punched out or cut through the double thickness of material. It is also possible to provide a serrated edge on only one of the sides of the spring member, or provide serrated edges on all four sides.

With the present invention, several advantages in the manufacture and assembly of poster frames are accomplished. For example, the serrated edges with irregular or pointed ends on the spring members eliminate the necessity for precise tolerances on the height H of the spring members. With the inventive spring members in accordance with the present invention, the base member 16 and cover member 18 of each frame section 12 are more firmly held together without the necessity of maintaining strict tolerances.

Also with the present invention, it is not necessary to use rail locks or staking procedures for holding the base and cover members from sliding laterally, as disclosed in U.S. Pat. No. 4,958,458. The present invention thus eliminates an additional machining and assembly step, and creates a lower cost and easier to manufacture product.

The present invention can also be used with frame sections of any size and shape. Moreover, providing teeth which mate with adjacent teeth in adjacent spring members, such as shown in FIG. 6, provide for ease of manufacture without creating waste materials.

As shown in FIG. 2, typically two spring members 40 are utilized in each of the frame sections 12 of the poster frame 10. For longer frame members, often three or more spring members 40 are utilized. In accordance with the present invention, at least one of the spring members 40 in each frame section 12 should have irregular edges, such as shown on spring members 40', 70, and 80. It is believed that use of a single spring member in accordance with the present invention in each frame section will prevent the cover member 18 from sliding longitudinally relative to the base member 16 over time.

While specific embodiments of the invention have been illustrated and described, it is to be understood that these embodiments are provided by way of example only and that the invention is not to be construed as being limited thereto, but only by the scope of the following claims.

What is claimed is:

1. A method of assembling a poster frame device, said poster frame device having a plurality of frame sections positioned in a polygonal shape, each of said frame sections having a base member and a cover member rotatably fastened together, and at least one spring member positioned between each of said base and cover members, said spring member having four edges, a first two of said edges opposed from one another being substantially planar, and the second two of said edges opposed from one another having projections thereon, said method comprising the steps of:

assembling one of said base members with one of said cover members to form said frame sections;

inserting at least one of said spring members between each of said assembled base and cover members, said spring member being positioned with said first two of said edges being in contact with said respective base and cover members;

longitudinally aligning said base and cover members; removing the spring member from the base and cover member rotating said at least one of said spring members 90° and reinserting the spring member between said base and cover members such that said second two of said edges are positioned in contact with said base and cover members.

2. The method of claim 1 wherein two of said spring members are provided between each of said base and cover members.

3. The method of claim 1 further comprising the step of arranging a plurality of said frame sections in a polygonal shape to form said poster frame device.

4. The method of claim 3 further comprising assembling said plurality of frame sections on a backing member.

* * * * *